US005779554A

United States Patent [19]

Sanders et al.

[11] Patent Number: 5,779,554

[45] Date of Patent: Jul. 14, 1998

[54] THREE-DIMENSIONAL BOWLING ALLEY MASKING UNIT

[75] Inventors: Winston T. Sanders; John R. Madsen; Sean Anderson, all of Richmond, Va.

[73] Assignee: AMF Bowling, Inc., Mechanicsville, Va.

[21] Appl. No.: 828,335

[22] Filed: Mar. 28, 1997

[51] Int. Cl.[6] ..... A63D 5/04

[52] U.S. Cl. ..... 473/54; 473/115

[58] Field of Search ..... 473/54, 64, 65, 473/73, 115; 52/144, 145, 473, 483

[56] References Cited

U.S. PATENT DOCUMENTS 3,018,105 1/1962 Grogoza .
3,287,873 11/1966 McDill .
3,738,656 6/1973 Rockwood et al. .
3,908,787 9/1975 Wenger et al. .
4,339,129 7/1982 Gautraud .
5,087,041 2/1992 Gagnon .
5,356,346 10/1994 Katje et al. .
5,411,442 5/1995 Stephens et al. .

*Primary Examiner*—William M. Pierce
*Attorney, Agent, or Firm*—David E. Dougherty

[57] ABSTRACT

A bowling alley masking unit comprising a pin curtain and a plurality of separate panels which are disposed laterally across at least one longitudinally extending bowling lane. The panels are disposed in a three-dimensional array with lateral and or longitudinal spacing in a overlapping arrangement. Each of the panels is supported by a forwardly extending bracket or cantilever.

8 Claims, 3 Drawing Sheets

THREE-DIMENSIONAL BOWLING ALLEY MASKING UNIT

FIELD OF THE INVENTION

This invention relates to a bowling alley masking unit and, more particularly, to a masking unit which covers a forward portion of a bowling alley pin-spotting mechanism, and which provides a unique three-dimensional effect.

BACKGROUND FOR THE INVENTION

The primary function of a bowling alley masking unit is to provide a visual barrier that hides or screens a forward portion of the pin-spotting mechanism from a bowler's view.

A second function is to provide decorative graphics. Such graphics are used to expand on a bowling center's color theme, and depict various art scenes which contribute to the attractiveness of the center.

Bowling proprietors recognize that color graphics provide a very significant visual impact for their investment dollar. It has also been recognized that changing the color graphics is a cost-effective way to update or refurbish an entire bowling center.

One approach to facilitate such changes is disclosed in the U.S. Pat. of Stephens et al., No. 5,411,442, which is assigned to the same assignee as the present invention and which is incorporated herein in its entirety by reference. As disclosed therein, the masking unit includes a generally rectangular frame and a cartridge adjacent to the frame, with a pair of rollers disposed within the cartridge. The unit also includes a pair of masking members, with one of the masking members attached to each of the rollers. Each of the masking members includes a display on one side thereof and is adapted to be rolled upon a roller for storage within the cartridge and unrolled to cover a portion of the pin spotter.

Another approach to a decorative masking unit is disclosed in the U.S. Pat. of Katje et al., No. 5,356,636. As disclosed therein, a series of stepped panels is disposed in front of a movable panel and extends from the top thereof to the ceiling of a bowling establishment. The panels are spaced periodically and at successively higher levels above and in front of the masking unit, and are used to decorate the area between the top of the masking unit and the ceiling of the bowling establishment.

Notwithstanding the aforementioned approaches, it is presently believed that there is a strong commercial demand for an improved masking unit, in accordance with the present invention. There should be a demand, because such units enable a bowling proprietor to easily and relatively inexpensively make significant changes in a bowling center's decor at a relatively low cost with a minimal amount of effort in a relatively short time. In addition, the units provide a novel, three-dimensional, depth-of-field effect. The masking units, in accordance with the present invention, are also relatively inexpensive to manufacture, durable, readily stored and shipped, and almost maintenance free.

BRIEF SUMMARY OF THE INVENTION

In essence, the present invention contemplates a bowling alley masking unit for hiding a bowling pin-setting apparatus from the view of a bowler and for providing a three-dimensional effect. The masking unit comprises a pin curtain which extends laterally across at least one longitudinally-extending bowling alley, above the bowling lane and in front of the pin-setting apparatus, positioning the pin curtain in front of the pin-setting apparatus, places it between the pin-setting apparatus, and a bowler at the opposite end of the alley. The masking unit also includes a plurality of panels which are preferably rectangular in shape, with a top, bottom and two sides, and means for supporting the panels above and across at least one bowling alley in front of the pin curtain. A first array, or row, of at least two of the panels are laterally spaced and generally aligned with one another across the lane. For example, the two panels may be co-planar and are in a generally upright position. A second array of panels, which may consist of a single panel, is spaced forwardly of the first array, with the panel or panels overlapping at least one side portion of at least two of the panels in the first array.

In a preferred embodiment of the invention, the panels are arranged in three rows, with two panels in each of a first and second array or row and a single panel in front of the second array. In this arrangement, a plurality of cantilevers, or brackets, extend outwardly from a cross-member and support the panels with the top of each panel in the first array at least as high or slightly higher above the alley than the top of the panels in the second array of panels and the top of the single or most forwardly spaced panel being higher than the top of the panels in the second array.

The invention will now be described in connection with the accompanying drawings, wherein like reference numerals have been used to indicate like parts.

DETAILED DESCRIPTION OF THE PREFERRED EMBODIMENTS OF THE INVENTION

Figure 1:
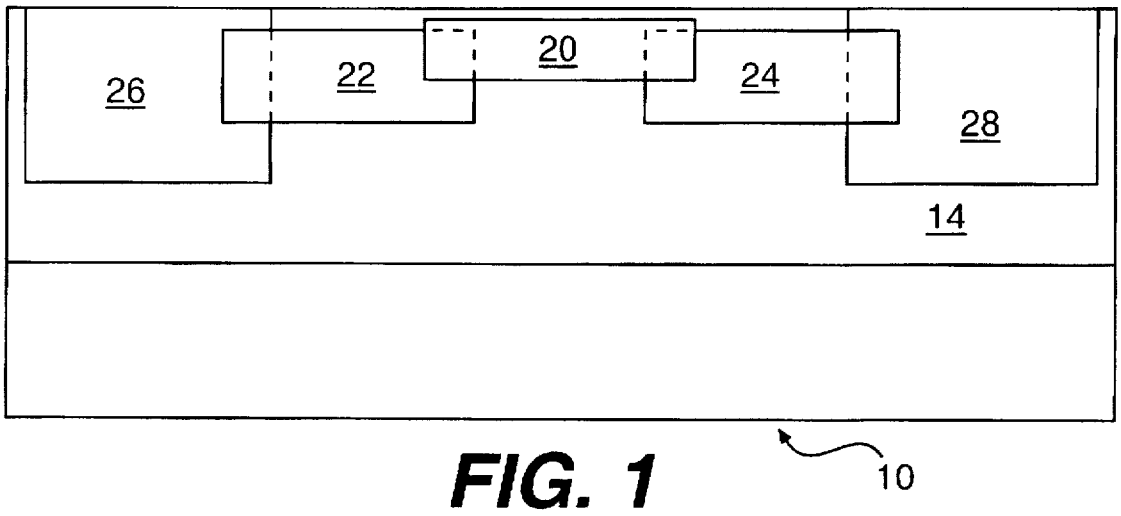
FIG. 1 is a front view of a masking unit according to one embodiment of the invention.
Figure 2:
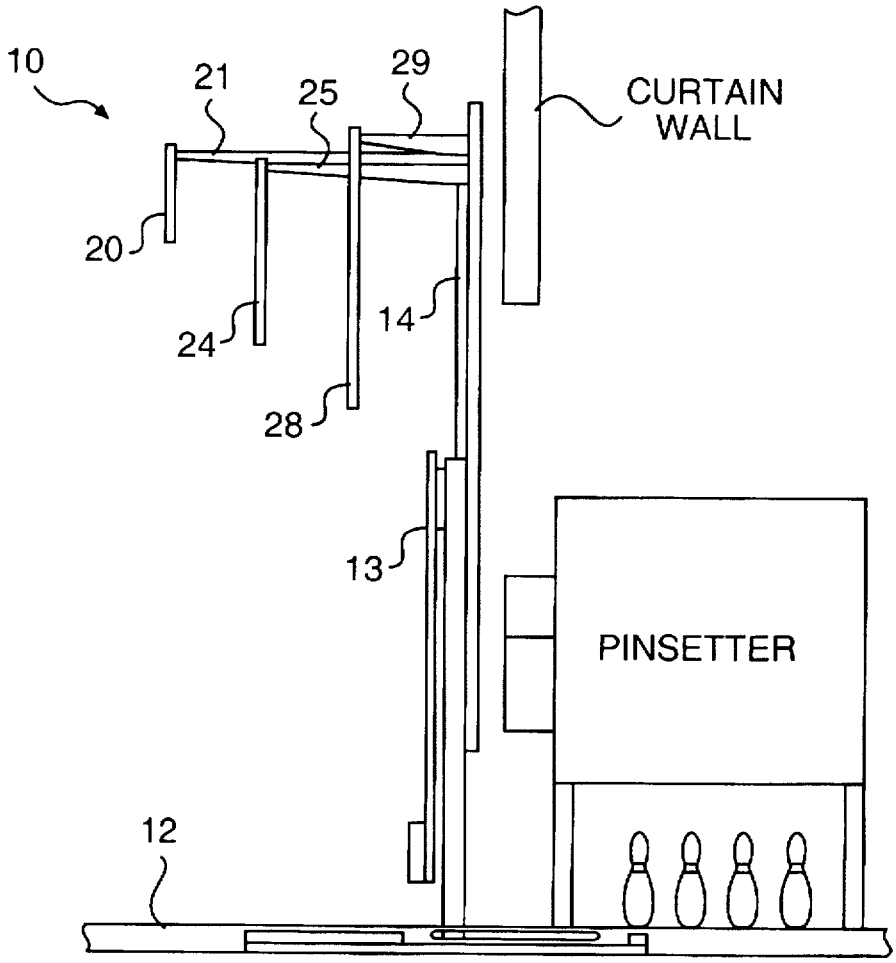
FIG. 2 is a side elevational view of the masking unit shown in FIG. 1.
Figure 3:
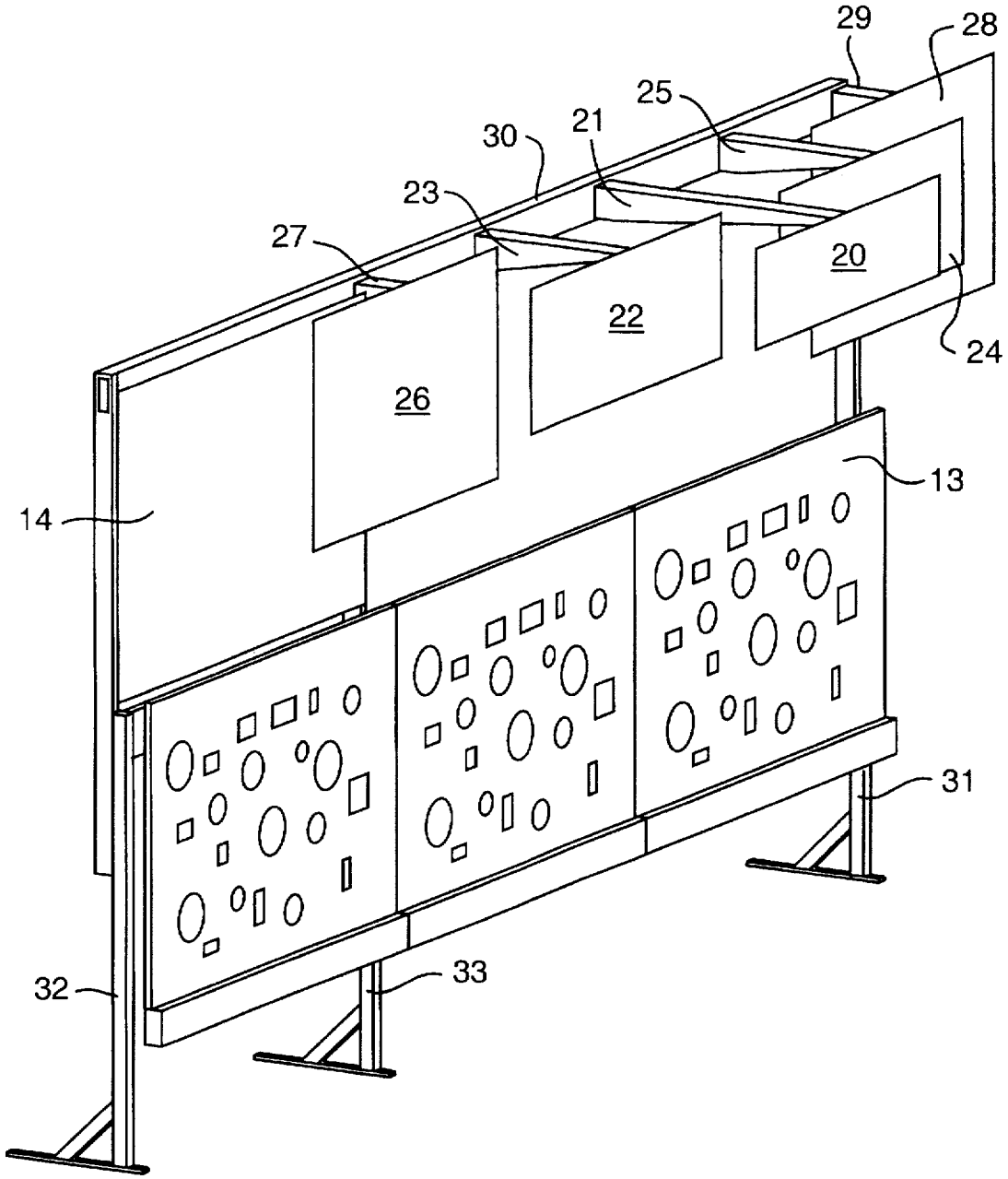
FIG. 3 is a perspective view of the bowling alley masking unit shown in FIGS. 1 and 2.

FIGS. 1–3 illustrate a masking unit 10 in accordance with a preferred embodiment of the invention. As illustrated, the masking unit 10 extends laterally across and above a longitudinally-extending bowling alley 12, which is shown in FIG. 2. The masking unit 10 includes a pin curtain 14 which provides a visual barrier that hides or screens a forward upper portion of the pin-setting, or pin-spotting mechanism 16 from a bowler's view. The pin curtain 14 is in front of and covers an upper portion of a curtain wall 15. (See FIG. 2). The pin curtain 14 may comprise one or more opaque sheets of material and typically includes suitable graphics thereon. Such graphics are used to expand on a bowling center's color theme and to depict various art scenes which contribute to the attractiveness of the center. The curtain 14 may include a lower portion 13 which may be a series of separate panels with suitable graphic thereon. Their lower portion 13 covers a lower portion of the pin-setting mechanism 16.

In bowling centers, it is common to provide pairs of companion bowling lanes which share a common ball return. Since it is common for bowlers on opposing teams to switch lanes between frames, the two lanes may share a common masking unit 10, which extends across the two alleys. In such cases, a single masking unit 10 is positioned in front of the two pin-spotting mechanisms 16, i.e., between the pin-spotting mechanisms 16 (only one of which is shown) and a bowler at the opposite end of the alley.

The masking unit 10 also includes a plurality of panels 20, 22, 24, 26 and 28, which are generally rectangular in shape. Means, such as a plurality of cantilevers, or brackets, 21, 23, 25, 27 and 29, extend outwardly from the plane of the pin curtain for supporting the panels 20, 22, 24, 26 and 28 in a generally upright position, across and above one or more bowling lanes. The brackets, 21, 23, 25, 27 and 29 are fixed to a suitable cross-member 30 which extends across a pair of vertical stanchions 31 and 32. A third vertical stanchion 33 may provide further support and would extend upwardly between two adjacent lanes.

As illustrated, the panels 20, 22, 24, 26 and 28 are arranged in two or more, and preferably three, rows or arrays, with one or more panels in each array. For example, a forward array is shown with a single generally-upright panel 20 which is spaced forwardly from the panels in the second and third arrays. The panel 20 is also preferably disposed, with its long axis in a horizontal plane and its short axis and the panel itself in a vertical plane.

The second row, or array, of panels includes panels 22 and 24, which are laterally spaced from each other across one or more bowling lanes. The panels 22 and 24 are generally aligned with one another and preferably lie in a common plane with their longest axis in a horizontal plane. In a preferred embodiment of the invention, the panels 22 and 24 are longitudinally spaced from the panel 20 by a distance of about 16 inches and spaced from one another by a distance which is less than the width of the panel 20. In this way, the sides of panel 20 overlap one side of panel 22 and one side of panel 24. The third row or array of panels includes panels 26 and 28 which are also laterally spaced from each other across one or more bowling lanes. These panels 26 and 28 are also generally aligned with one another and preferably lie in a common plane with their longest axis in a horizontal plane. As illustrated in FIG. 3, the panels 26 and 28 are positioned rewardly of panels 22 and 24 along the longitudinally axis of the bowling alley and or about 8 inches in front of the pin curtain and 16 inches behind panels 22 and 24. The panels 26 and 28 are spaced laterally from one another by a distance which is less than the horizontal extension of panels 22 and 24. In other words the outer sides of panels 22 and 24 overlap the inner sides of panels 26 and 28.

In a preferred embodiment of the invention, the panel 20 is smaller than the panels 22 and 24 and those panels 22 and 24 are about the same size if not the same size. The panels 22 and 24 are also smaller than panels 26 and 28 which are also preferably of equal size. In addition the panels are disposed with the tops of each panels at about the same height or at the same height above the lanes as the panels in a forwardly disposed array. However, it is contemplated that the forward array maybe slightly lower than the row immediately behind and that the panels in that array may be somewhat lower than the panels in the third array.

Figure 5:
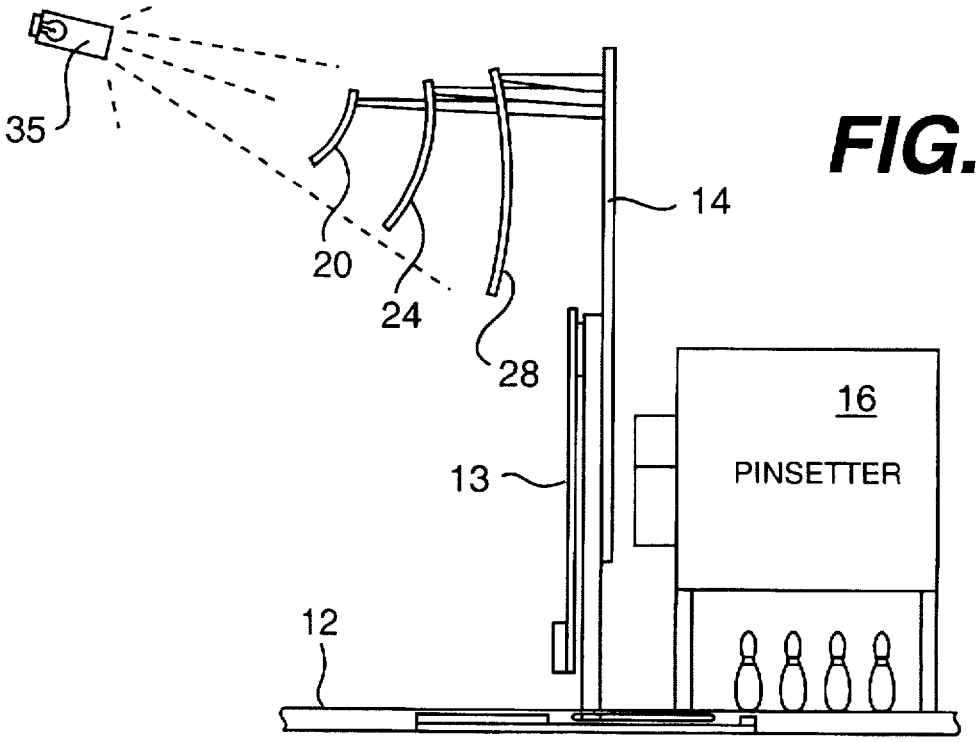
FIG. 5 is a side elevational view of a masking unit according to a further embodiment of the invention.

In another embodiment of the invention, shown in FIG. 5, it is contemplated that the panels will have a concave or "C" shape. This concave shape will be relatively shallow and may aide in reflecting light back towards a light source 35 which is normally disposed forwardly and above the panels. It is presently believed that this arrangement will reduce glare in the eyes of a bowler.

Figure 4:
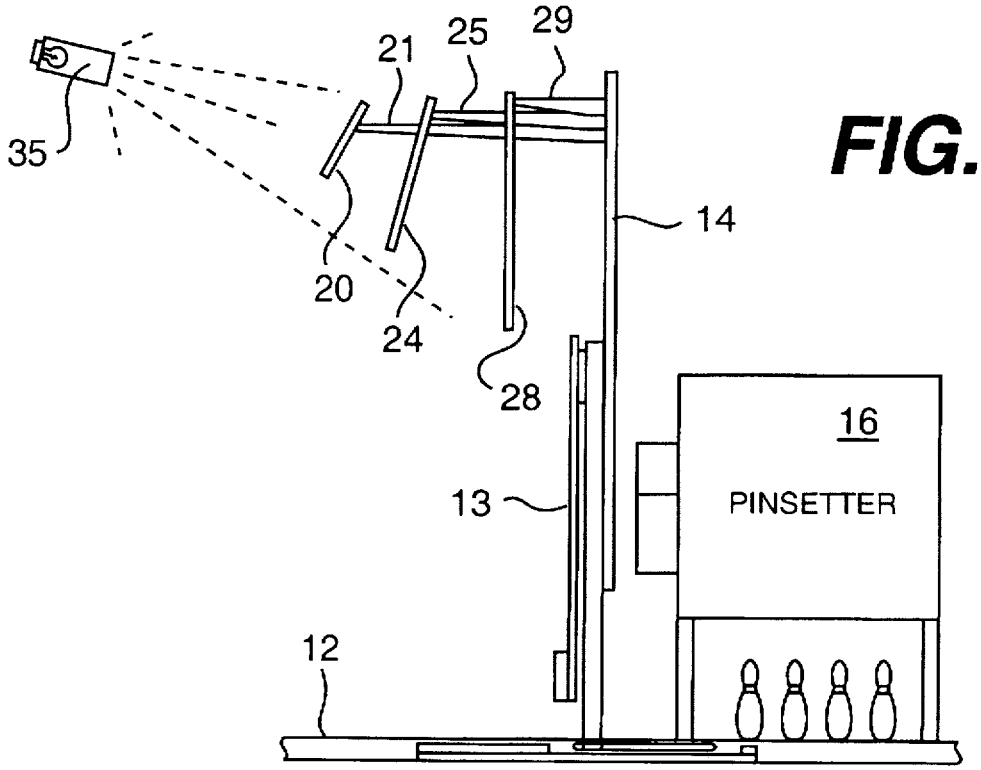
FIG. 4 is a side elevational view of a bowling alley masking unit according to another embodiment of the invention.

Another approach to reducing glare is shown in FIG. 4 wherein the panels are flat, but slightly canted or angled upwardly in an effort to reduce glare. In such an arrangement the panels may be angled at approximately 10° from vertical.

While the invention has been described in connection with its preferred embodiments, it should be recognized that changes and modifications maybe made therein without departing from the scope of the independent claims.

What is claimed is:

1. A bowling alley masking unit for hiding a bowling pin setting apparatus from the view of a bowler and for providing a three dimensional effect, said massing unit comprising a pin curtain adapted to extend laterally across at least one longitudinally extending bowling lane in front of pin setting apparatus and between a pin setting apparatus and a bowler, a plurality of panels each of which has a top, bottom and two side portions and means for supporting said panels across and above a bowling lane in front of said pin curtain, said means for supporting said panels comprising a plurality of cantilevers with one cantilever for each panel extending forwardly from said curtain a first array of at least two of said panels laterally spaced from each other and generally aligned across the lane in a generally vertical position, at least one of said panels other than those in said array spaced forwardly of said array and overlapping a side portion of at least two of said panels in said array.

2. A bowling alley masking unit in accordance with claim 1 in which the top of said one of said panels which is spaced forwardly of said array is higher above the alley than the top of said panels in said array.

3. A bowling alley masking unit for hiding a bowling alley pin setting apparatus from the view of a bowler and for providing an enhanced three dimensional effect, said masking unit comprising a pin curtain adapted to extend laterally across at least one longitudinally extending bowling lane in front of a pin setting apparatus and between a pin setting apparatus and a bowler, a plurality of generally rectangular panels each of which has a top, a bottom and two sides, and means for supporting said panels across and above a plurality of bowling lanes in front of said pin curtain, a first array of at least two of said panels laterally spaced from each other and generally aligned with one another across the lane, a second array of at least two of said panels other than those in said first array laterally spaced from each other and generally aligned with one another across said lane with said panels in said second array disposed forwardly of said panels in said first array and overlapping at least one of said sides of at least two of said panels in said first array, and at least one of said panels other than those in said first and second arrays disposed forwardly of said second array and overlapping at least one side of at least two of said panels in said first array and a source of light for illuminating said panels.

4. A bowling alley masking unit according to claim 3 wherein said panels are curved to form a relatively shallow C-shaped concave cross-section with a concave portion of the panel facing toward the source of light.

5. A masking unit in accordance with claim 3 in which said panels are offset from vertical to reflect light upwardly toward the ceiling.

6. A masking unit in accordance with claim 5, in which said forwardly most panel is smaller than the panels next behind.

7. A masking unit in accordance with claim 6, in which said panels in said second array are smaller than said panels in said first array.

8. A masking unit in accordance to claim 7, in which two of said arrays include two panels.

* * * * *